United States Patent [19]

Kristiansen et al.

[11] 4,274,869

[45] Jun. 23, 1981

[54] DESULPHURIZATION OF METALS

[75] Inventors: Jan O. Kristiansen, Olmsted Falls; C. Richard Lynham, Medina, both of Ohio

[73] Assignee: Foseco International Limited, Birmingham, England

[21] Appl. No.: 141,816

[22] Filed: Apr. 21, 1980

[30] Foreign Application Priority Data

Apr. 19, 1979 [GB] United Kingdom ..... 13616/79

[51] Int. Cl.[3] ..... C21C 7/02

[52] U.S. Cl. ..... 75/53; 75/58

[58] Field of Search ..... 75/53, 58, 257

[56] References Cited

U.S. PATENT DOCUMENTS

| | | | |
|---|---|---|---|
| 3,326,273 | 6/1967 | Jago | 164/349 |
| 3,771,999 | 11/1973 | Fedock | 75/257 |
| 3,793,006 | 2/1974 | Kawawa | 75/257 |
| 3,964,900 | 6/1976 | Krupman | 75/58 |
| 4,014,684 | 3/1977 | Jones | 75/58 |

FOREIGN PATENT DOCUMENTS

| | | | |
|---|---|---|---|
| 764157 | 12/1956 | United Kingdom | 75/58 |
| 1288872 | 9/1972 | United Kingdom | 75/58 |
| 1484456 | 9/1977 | United Kingdom | 75/58 |

*Primary Examiner*—P. D. Rosenberg

*Attorney, Agent, or Firm*—Cushman, Darby & Cushman

[57] ABSTRACT

The invention provides, for use in desulphurizing molten steel or iron, a desulphurizing composition in compacted form comprising lime, an alkali metal or alkaline earth metal fluoride or mixture thereof and sufficient ballmill dust to facilitate the compaction of the composition. The composition is preferably added to the molten metal in a ladle.

20 Claims, No Drawings

DESULPHURIZATION OF METALS

The invention relates to desulphurisation of iron or steel and especially of molten steel while held in a metallurgical vessel such as a ladle.

It is well-known to add lime usually with a fluxing additive such as fluorspar to molten steel or iron in order to desulphurise the metal. British patent specification No. 1288872 proposes certain mixtures of lime, sodium carbonate and fluorspar and, whilst it is said that the mixtures may be powders, there is also a mention of the mixtures being in granular or tablet form. However, lime-based desulphurisers currently used are, in practice, added in powder form and this has several disadvantages. Commonly bags of the powder are added directly to a ladle and a lot of the powder is lost as dust, much fume and/or smoke is evolved and the operators need to add numerous bags of the powder to the ladle as the metal is tapped into it and/or to place the powder on the bottom of the ladle before tapping. Also, the operators may be exposed to great heat from the metal during addition of the bags. Use of desulphurising compositions in coherent solid form, e.g. as tablets, would evolve an additional manufacturing step, i.e. forming the ingredients into tablets etc., as compared with powders and there would be the need to give the tablets etc. adequate strength during handling, storage and transport whilst ensuring very rapid disintegration in use.

It is well-known to include a metallic reducing agent, e.g. an easily oxidisable metal such as aluminium, in a desulphuring powder see e.g. British patent specification No. 1484456. The oxidation of the aluminium facilitates the formation of a fluid mobile slag and the aluminium generally aids in desulphurisation by combining with excess oxygen. British patent specification 1484456 requires the use of alumina to aid the formation of the slag and the alumina and any desired aluminium may be provided by use of ballmill dust.

Ballmill dust is well-known as a source of aluminium and alumina. Ballmill dust is obtained from the skimmings and drosses formed during the melting of aluminium and aluminium alloys in an oxygen-containing atmosphere. Usually the skimmings and drosses pass to the secondary melters for pulverizing by ballmilling or grinding. In some cases the dross may need to be reduced in size in a jawcrusher but generally it is sufficiently fine for ballmilling without any pretreatment. After ballmilling it is usual to screen the residue. The coarse material (normally +10 or +16 Tyler mesh) contains most of the metallic aluminium and is removed for remelting. (The word TYLER is a Registered Trade Mark.) The fine material, which is called ballmill dust, may be washed by the producer in order to remove water-soluble salts.

The dross usually is composed mainly of alumina (resulting from the oxidation of the molten metal) and particles of aluminium or aluminium alloy, together with a few percent each of metallic contaminants such as copper, silicon, iron, zinc, magnesium, and/or their compounds. Some silica is generally present as are fluorides and chlorides of sodium, potassium, and/or other metals (from fluxing ingredients and their various reaction products). Aluminium nitride is also usually present, resulting from the reaction between aluminium and atmospheric nitrogen.

Generally the fluxes used with aluminium are mixtures containing one or more of the following components: sodium fluoride, sodium chloride, sodium sulphate, potassium chloride and cryolite.

The ballmill dust may contain up to 10% by weight sodium chloride and values of 10 to 18% by weight total fluorides (water-soluble and water-insoluble) have been noted. Sodium aluminate, sodium carbonate and the oxides of the alloying elements are also often found.

The residual aluminium content of ballmill dust depends on the source and on the type of processing it receives but normally it is between 10 and 30% by weight. It may however contain as little as 5 or as much as 60 or 70% by weight metallic aluminium. For optimal exothermic performance when pouring ferrous metals, it is preferred that the ballmill dust contain from about 5 to about 45 weight percent alumunium metal (e.g. about 10 to 25%), and accordingly it may in some instances be desirable to fortify aluminium-lean dust with blown or ground aluminium metal. With non-ferrous metal casting a higher aluminium content may be desirable.

Irrespective of the materials present in the desulphurising composition, it is usual to locate the powder in the bottom of the ladle prior to tapping into the ladle and/or to add the powder in bags during the tapping or to inject the powder, in a non-oxidising gas such as argon or nitrogen, via a lance into the metal in the ladle. Addition of the powder by injection requires the use of special equipment and the lances are short-lived in view of the conditions of use.

It has now been appreciated that if the desulphurising composition is presented in coherent solid form such as a briquette, less dust will be evolved and lost, there will be less evolution of polluting fume and/or smoke and the operatives will no longer need to throw bags into the ladle during and/or before tapping and to get so close to the exposed molten metal. Further, the invention is based on the appreciation that one of the ingredients which may be present to advantage in a desulphurising composition greatly facilitates the manufacture of briquettes or like articles of desulphurising composition.

According to the invention there is provided for use in desulphurising molten steel or iron, a desulphurising composition in compacted form comprising lime, an alkali metal or alkaline earth metal fluoride or a mixture thereof, and sufficient ballmill dust to facilitate the compaction of the composition. Sodium carbonate amy also be an ingredient.

An advantage of the compacted composition, e.g. briquettes, is that such briquettes can be housed in a hopper and fed down the alloying chute through which alloying additions are made to the molten metal. By this means the desulphurising composition can be added in a manner which is particularly fast and free of hazard and pollution to the operator. There is no need for a second straight flow-through chute such as may be needed for the addition of bagged desulphurising powder.

While the desulphurising composition may be compacted in any manner, it is much preferred to form the shapes, e.g. briquettes, in a contra-rotating roll press.

The inclusion of the ballmill dust enables the briquettes or the like to be readily formed without need for excessive pressures or special binders. Furthermore, the briquettes can readily be made with good resistance to damage during handling, storage and transport and yet with the ability to disintegrate very rapidly in use and to achieve a degree of desulphurisation as good as or better than that obtainable by use of a comparable powder product at a given application rate and under other standardised conditions.

The proportion of the ballmill dust must be adjusted according to the need to form a compacted form. The ballmill dust serves not only to bind the other ingredients together in a way which will maintain the integrity of the shape, but it also is formed of particles of a soft nature which means that there are no sharp pieces or corners to damage the compacting equipment beyond that due to normal wear and tear. The degree of softness depends on the relative proportions of aluminium and alumina making up the ballmill dust and this can vary dependent on the source of supply. Also the degree of softness required not to damage the compacting equipment will be related to the other ingredients in the composition. It is well within the expertise of those skilled in the art to select from the available ballmill dusts those best suited to any particular compacting equipment and having regard to the other ingredients.

While briquettes have been specifically mentioned, the compact may take many shapes, other examples being nodules, tablets, blocks and bricks.

The invention further includes a method of making a shaped form of a desulphurising agent comprising subjecting the desulphurising composition above defined to compaction thereby to form the compact without causing damage to the press rolls.

The invention further includes a method of desulphurising molten steel or iron (such as blast furnace iron) comprising treating the molten metal in a metallurgical vessel with the desulphurising composition in compacted form. The invention further includes a preferred method of desulphurising molten metal located in a ladle below a chute through which alloy additives are passed to the vessel, comprising passing down the chute and into the molten metal the desulphurising composition in compacted form.

When the molten metal is steel it will typically be a killed steel such as aluminium-killed steel. Especially preferred are medium carbon silicon-aluminium killed steels.

The invention is illustrated by the following Examples in which all parts are by weight.

EXAMPLE 1

A dry mix was made of the following ingredients:

| | |
|---|---|
| calcined lime | 60 |
| ballmill dust | 20 |
| fluorspar | 20 |

and the mix was then passed to a contra-rotating roll press having twin rollers and shaped to form almond shaped briquettes about 3 cm×2 cm×1.5 cm in size. It was observed that the compaction caused no damage to the rolls beyond the expected wear and tear.

The briquettes formed were packed in airtight steel or fibre drums. These were then shipped to a steel plant. When required operators held the drums over the mouth of the alloying chute over a ladle containing molten steel and emptied the drum on top of the alloys already present in the chute. During tapping into the ladle the briquettes were fed continuously following the alloys such that within 60 seconds all the briquettes fell down the chute into the steel and there was little dust, fume or smoke (the ladle was visible throughout). The operators had no occasion to approach the hot metal in the ladle.

In field evaluations with an application rate of 3.4 kg. per ton of steel, the average sulphur reduction using the briquettes of the invention was 30% for low to medium carbon, silicon-aluminium killed steel. This figure is comparable with that achieved using 4.5 kg, per ton of steel, of powdered material but in the case of powders there was considerable evolution of fume and release of dust and the operator was exposed to considerable heat and had to expend a considerable amount of physical energy.

EXAMPLE 2

A mix was made of

| | |
|---|---|
| calcined lime | 55 |
| ballmiss dust | 15 |
| fluorspar | 25 |
| calcined sodium carbonate | 5 |

The mix was then briquetted in a roll press at a pressure of 1.26 tonne/cm$^2$. Even in powder form the composition is an efficient desulphuriser and the briquettes were strong enough for iron and/or steel desulphurisation purposes.

EXAMPLE 3

A mix was made and briquetted in manner of Example 1 from

| | |
|---|---|
| calcined lime | 60 |
| ballmill dust | 15 |
| fluorspar | 15 |
| sodium carbonate | 5 |
| aluminium grindings | 5 |

The mix was briquetted at a pressure of 1.26 tonne/cm$^2$. Even in powder form the composition is an efficient desulphuriser and the briquettes were strong enough for iron and/or steel desulphurisation purposes.

We claim:

1. A method of desulphurising a molten ferrous metal selected from the group consisting of steel and iron comprising treating the molten metal with a composition in compacted form comprising lime, a metal fluoride selected from the group consisting of alkali metal and alkaline earth metal fluorides, and ballmill dust.

2. A method according to claim 1 in which the molten metal is killed steel.

3. A method according to claim 1 in which the molten metal is an aluminium-killed steel.

4. A method according to claim 1 in which the molten metal is a medium carbon silicon-aluminium-killed steel.

5. A method according to claim 1 in which the molten metal is steel and the treatment is effected in a ladle by introducing the composition into said ladle down a chute for introducing alloying additives into said ladle as the molten steel is introduced into said ladle.

6. For use in a method of desulphurising a molten ferrous metal selected from the group consisting of steel and iron, a desulphurising agent comprising lime, a metal fluoride selected from the group consisting of alkali metal and alkaline earth metal fluorides, and ballmill dust, said agent being in compacted form and containing a sufficient amount of the ballmill dust to facilitate the compaction.

7. A desulphurising agent according to claim 6 containing 15 to 20% by weight of the ballmill dust.

8. A method of making a desulphurising agent comprising subjecting to pressure a particulate mixture comprising lime, a metal fluoride selected from the group consisting of alkali metal and alkaline earth metal fluorides, and ballmill dust.

9. A method according to claim 8 in which the pressure is exerted by means of a roll press.

10. A method according to claim 9 in which the press is a contra-rotating roll press.

11. A desulphurising agent as recited in claim 6 in the compacted form of a briquette.

12. A desulphurising agent as recited in claim 6 in the compacted form of a nodule.

13. A desulphurising agent as recited in claim 6 in the compacted form of a tablet.

14. A desulphurising agent as recited in claim 6 in the compacted form of a block.

15. A desulphurising agent as recited in claim 6 in the compacted form of a brick.

16. A method as recited in claim 8 wherein said subjecting to pressure step is practiced utilizing a press forming the desulphurising agent into briquettes.

17. A method as recited in claim 9 wherein said subjecting to pressure step is practiced utilizing a press forming the desulphurising agent into nodules.

18. A method as recited in claim 8 wherein said subjecting to pressuure step is practiced utilizing a press forming the desulphurising agent into tablets.

19. A method as recited in claim 8 wherein said subjecting to pressure step is practiced utilizing a press forming the desulphurising agent into blocks.

20. A method as recited in claim 8 wherein said subjecting to pressure step is practiced utilizing a press forming the desulphurising agent into bricks.

* * * * *